US008794326B2

(12) United States Patent
Le et al.

(10) Patent No.: US 8,794,326 B2
(45) Date of Patent: Aug. 5, 2014

(54) PERFORATING GUN WITH VARIABLE FREE GUN VOLUME

(75) Inventors: Cam Le, Houston, TX (US); Dennis J. Haggerty, Burleson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/345,310

(22) Filed: Jan. 6, 2012

(65) Prior Publication Data

US 2012/0181026 A1 Jul. 19, 2012

(30) Foreign Application Priority Data

Jan. 19, 2011 (WO) ..... PCT/US2011/021722

(51) Int. Cl.
*E21B 43/116* (2006.01)
*E21B 43/119* (2006.01)

(52) U.S. Cl.
CPC ..... *E21B 43/1195* (2013.01)
USPC ..... 166/297; 166/55; 166/299

(58) Field of Classification Search
CPC ..... E21B 21/006; E21B 43/119; E21B 43/28; E21B 43/283; E21B 43/281; F42B 3/02; F42B 3/08
USPC ..... 166/55, 297, 299
See application file for complete search history.

(56) References Cited

U.S. PATENT DOCUMENTS

| | | | | |
|---|---|---|---|---|
| 3,174,545 | A * | 3/1965 | Mohaupt | 166/299 |
| 4,253,523 | A * | 3/1981 | Ibsen | 166/299 |
| 4,391,337 | A * | 7/1983 | Ford et al. | 175/4.6 |
| 6,446,727 | B1 * | 9/2002 | Zemlak et al. | 166/308.1 |
| 6,520,258 | B1 * | 2/2003 | Yang et al. | 166/297 |
| 6,554,081 | B1 * | 4/2003 | Brooks et al. | 175/4.54 |
| 6,598,682 | B2 * | 7/2003 | Johnson et al. | 166/370 |
| 7,284,612 | B2 * | 10/2007 | Ratanasirigulchai et al. | 166/297 |
| 7,621,342 | B2 | 11/2009 | Walker | |
| 8,006,762 | B2 * | 8/2011 | Burleson et al. | 166/297 |
| 2003/0089498 | A1 * | 5/2003 | Johnson et al. | 166/297 |
| 2004/0089449 | A1 * | 5/2004 | Walton et al. | 166/297 |

(Continued)

FOREIGN PATENT DOCUMENTS

| | | | |
|---|---|---|---|
| EP | 1780374 | A1 | 5/2007 |
| MX | PA04008972 | A | 6/2005 |
| MX | PA04010637 | A | 6/2005 |
| WO | 2011005415 | A1 | 1/2011 |

OTHER PUBLICATIONS

Entry for "capsule gun" from the Schlumberger Oilfield Glossary, accessed Jun. 11, 2012 via www.glossary.oilfield.slb.com.*

(Continued)

*Primary Examiner* — Blake Michener
(74) *Attorney, Agent, or Firm* — Smith IP Services, P.C.

(57) ABSTRACT

A method of adjusting a pressure reduction to occur in a wellbore following firing of at least one perforating gun can include determining a desired free gun volume which corresponds to a desired pressure reduction in the wellbore resulting from firing of the perforating gun, and varying a free gun volume of the perforating gun until the free gun volume is substantially the same as the desired free gun volume. A well system can include at least one perforating gun positioned in a wellbore, the perforating gun comprising multiple perforating charges and a free gun volume, and the free gun volume being reduced by presence of a flowable material about the multiple perforating charges.

6 Claims, 4 Drawing Sheets

(56) References Cited

U.S. PATENT DOCUMENTS

| | | | | |
|---|---|---|---|---|
| 2004/0099418 | A1 | 5/2004 | Behrmann et al. | |
| 2004/0159432 | A1* | 8/2004 | Johnson et al. | 166/297 |
| 2009/0038800 | A1* | 2/2009 | Ravi et al. | 166/292 |
| 2009/0078420 | A1* | 3/2009 | Caminari et al. | 166/297 |
| 2009/0151949 | A1* | 6/2009 | Marya et al. | 166/297 |
| 2009/0255674 | A1* | 10/2009 | Boney et al. | 166/284 |
| 2010/0133005 | A1 | 6/2010 | Bell et al. | |
| 2010/0200235 | A1* | 8/2010 | Luo et al. | 166/284 |
| 2011/0005761 | A1* | 1/2011 | Luo et al. | 166/308.2 |
| 2013/0192829 | A1* | 8/2013 | Fadul et al. | 166/297 |

OTHER PUBLICATIONS

Halliburton; "Tubing Conveyed Perf.", Technichal update, dated May 1, 1997, 10 pages.

Halliburton; "Perforating Systems Manual: Extreme Over balance Perforating", product manual, No. D00369351, Revision A, dated Apr. 2009, 23 pages.

Halliburton; "G-Force System: Allows Perforating in any direction irrespective of the gun's position relative to the casing", product article, H07960-A4, dated Jul. 2010, 2 pages.

Dennis Haggerty; "The use of innocuous powdered materials to reduce the free gun volume in an API RP 19 B Section IV Perforating Gun", product description, published Nov. 10, 2009, 6 pages.

Search Report issued Jul. 26, 2011 for International Application No. PCT/US2011/021722, 5 pages.

Written Opinion issued Jul. 26, 2011 for International Application No. PCT/US2011/021722, 4 pages.

Office Action issued Apr. 4, 2013 for U.S. Appl. No. 13/210,303, 29 pages.

Khulief, et al; "Vibration analysis of drillstring with self-excited stick-slip oscillations", Science Direct, Journal of Sound and Vibration 299 (2007) 540-558, dated Oct. 2, 2006, 19 pages.

Paslay, et al.; "Stress Analysis of Drillstring", SPE 27976, dated Aug. 29-31, 1994, 14 pages.

Canadian Office Action issued Jan. 23, 2013 for Canadian Patent Application No. 2,764,106, 2 pages.

Office Action issued Mar. 31, 2014 for Colombian patent application No. 12-052940, 13 pages.

English translation of Office Action issued Mar. 31, 2014 for Colombian patent application No. 12-052940, 23 pages.

* cited by examiner

PERFORATING GUN WITH VARIABLE FREE GUN VOLUME

CROSS-REFERENCE TO RELATED APPLICATION

This application claims the benefit under 35 USC §119 of the filing date of International Application Ser. No. PCT/US11/21722 filed Jan. 19, 2011. The entire disclosure of this prior application is incorporated herein by this reference.

BACKGROUND

The present disclosure relates generally to equipment utilized and operations performed in conjunction with a subterranean well and, in an embodiment described herein, more particularly provides a perforating gun with a variable free gun volume.

It is well known that a pressure reduction can be experienced in a wellbore when well fluid rushes into void spaces of a perforating gun after the perforating gun is fired. Unfortunately, however, this pressure reduction can be too large, creating an excessively underbalanced condition which can break down a perforated formation near the wellbore, leading to production of sand, etc.

For this reason and others, it would be advantageous to be able to selectively vary a free gun volume of a perforating gun.

SUMMARY

In carrying out the principles of the present disclosure, improvements are provided to the art of well perforating. One example is described below in which a free gun volume of a perforating gun can be increased or decreased, based on a desired pressure reduction in a wellbore following detonation of the perforating gun. Another example is described below in which a material is flowed about perforating charges in the perforating gun, to thereby reduce the free gun volume.

In one aspect, this disclosure provides to the art a method of adjusting a pressure reduction to occur in a wellbore following firing of at least one perforating gun. The method can include determining a desired free gun volume which corresponds to a desired pressure reduction in the wellbore resulting from firing of the perforating gun; and varying a free gun volume of the perforating gun until the free gun volume is substantially the same as the desired free gun volume.

This method can be performed separately for each perforating gun or set of perforating guns used to perforate multiple formation intervals.

In another aspect, this disclosure provides to the art a well system which can include at least one perforating gun positioned in a wellbore, the perforating gun comprising multiple perforating charges and a free gun volume, and the free gun volume being reduced by presence of a flowable material about the multiple perforating charges.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
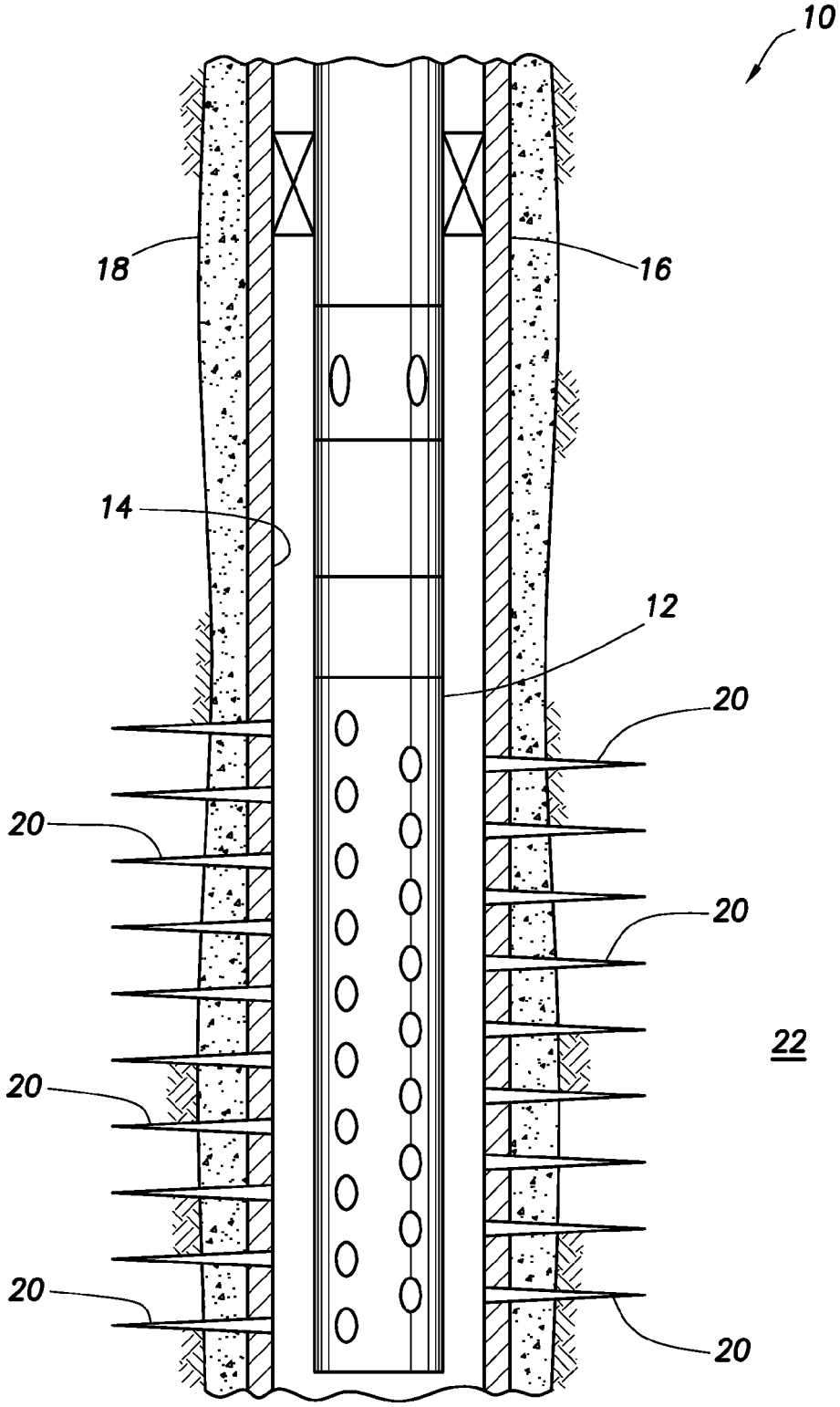
FIG. 1 is a representative partially cross-sectional view of a well system and associated method which can embody principles of the present disclosure.

Representatively illustrated in FIG. 1 is a well system 10 and associated method which can embody principles of the present disclosure. In the example depicted in FIG. 1, a perforating gun 12 is installed in a wellbore 14 lined with casing 16 and cement 18. The perforating gun 12 is used to form perforations 20 extending through the casing 16 and cement 18, so that communication is established between the wellbore 14 and an earth formation 22 surrounding the wellbore.

Perforating charges 24 (not visible in FIG. 1, see FIG. 2) in the perforating gun 12 are detonated to form the perforations 20. Following the detonation of the perforating charges 24, there is a reduction in pressure in the wellbore 14 due to fluids in the wellbore flowing into the now-perforated gun 12.

In one unique aspect of the system 10, a free gun volume of the perforating gun 12 can be selectively varied, so that a predetermined desired pressure reduction in the wellbore 14 will follow detonation of the perforating charges 24. The free gun volume is the volume in the perforating gun 12 into which the well fluid flows following detonation of the perforating charges 24.

This free gun volume is typically sealed at atmospheric pressure when the perforating gun 12 is assembled at surface. By varying the free gun volume, the pressure reduction in the wellbore 14 can be selectively tailored to particular wellbore circumstances (e.g., different fluids, pressures, temperatures, etc.), to particular formation characteristics (e.g., extent of consolidation, desired debris removal, etc.), to other well equipment (e.g., to prevent adversely affecting a packer, etc.), and/or for other purposes.

At this point it should be pointed out that the well system 10 and method as depicted in the drawings and described herein is merely one example of a wide variety of different well systems and methods which can incorporate the principles of this disclosure. Therefore, it should be understood that those principles are not limited in any manner to the details of the well system 10 and method, or of any of their components.

Figure 2:
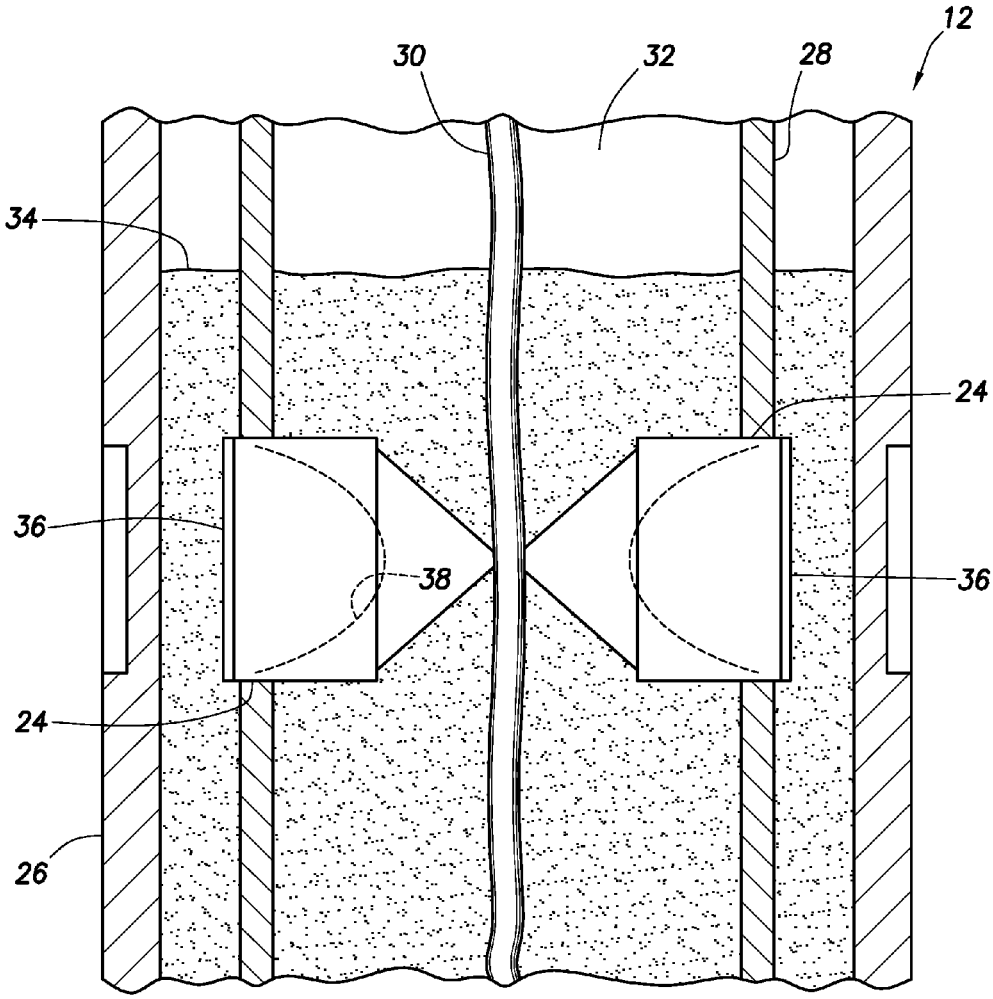
FIG. 2 is a representative partially cross-sectional view of a perforating gun which may be used in the well system and method of FIG. 1.

Referring additionally now to FIG. 2, an example of a perforating gun 12 which can be used in the well system 10 and method is representatively illustrated. Of course, the perforating gun 12 can also be used in other well systems and methods, as well.

The perforating gun 12 includes a generally tubular outer body 26, the perforating charges 24 and, in this example, a generally tubular charge carrier 28. A detonating cord 30 transfers a detonation train along the length of the perforating gun 12.

FIG. 2 depicts only a small axial section of the perforating gun 12. Although two perforating charges 24 are shown in FIG. 2, any number and/or arrangement of perforating charges may be used in other examples. The charge carrier 28 is not necessarily tubular in form, since other shapes of charge carriers (e.g., sheet metal, formed wire, strips, plastics, molded, cast, etc.) can be used in other examples.

It is also not necessary that all of the components of the perforating gun 12 are separately constructed. Instead, any or all of the components could be integrated with any other components. It is not necessary for all of the components of the perforating gun 12 described herein to be present in a perforating gun which comes within the scope of this disclosure.

The perforating gun 12 has a free gun volume 32 which will be occupied by fluid from the wellbore 14 following detonation of the perforating charges 24. The free gun volume 32 is reduced, as depicted in FIG. 2, by addition of a material 34 into the perforating gun 12.

By reducing the free gun volume 32, a pressure reduction in the wellbore 14 following firing of the perforating gun 12 will also be reduced. This is due to the fact that fluid from the wellbore 14 will have less volume to occupy in the perforating gun 12 after the charges 24 are detonated.

The material 34 is preferably flowable about the components of the perforating gun 12, for ease of installation. The material 34 could be in granular, powder, fluid, or other form. The material 34 preferably has the capability to flow through small openings and fill voids in the outer body 26.

If in powder form, moisture is preferably avoided, however if the material 34 comprises sodium chloride, some moisture from humidity during assembly of the perforating gun 12 can be permitted. If magnesium chloride is used in the material 34, however, moisture is preferably avoided.

The material 34 is preferably dispersible after the perforating operation, so that it does not pose a possible hindrance to future operations. The material 34 could, for example, be dissolvable in the well fluid. When the material 34 is dispersed, it preferably does not adversely affect the formation 22, or any components of the well (e.g., via corrosion, etc.).

If the well fluid is aqueous, the material 34 could be at least partially water-dissolvable. Suitable water-dissolvable materials can include NaCl, KCl, $MgCl_2$, $CaCl_2$, etc. NaCl, KCl and $CaCl_2$ in particular are heat resistant, with melting points well above 300 degrees C.

If the well fluid comprises a hydrocarbon fluid, the material 34 could be at least partially dissolvable in the hydrocarbon fluid. Suitable materials can include rosemary extract powder, etc.

A cover 36 can be positioned over the outer ends of the charges 24, to thereby prevent the material 34 from getting into an interior 38 of each charge. Exclusion of the material 34 from the interior 38 of the charge 24 allows an optimum jet to be formed in the interior of the charge when its explosive is detonated. Suitable materials for the covers 36 can include aluminum, aluminum foil, plastics, sheet metal, etc.

In one method of using the material 34, a desired pressure reduction in the wellbore 14 is determined based on characteristics of the formation 22 (e.g., the formation structure, type, extent of consolidation, porosity, permeability, etc.), dimensions of the various components, fluids in the wellbore, etc. A desired free gun volume can then be determined, based on the desired pressure reduction.

The perforating gun 12 can be assembled with the perforating charges 24, charge carrier 28 and detonating cord 30, leaving a free gun volume 32 in the interior of the outer body 26. Then the free gun volume 32 can be reduced by adding the material 34 to the interior of the body 26. The free gun volume 32 is reduced until it matches the desired free gun volume to produce the desired pressure reduction in the wellbore 14.

Of course, other methods may be used in keeping with the principles of this disclosure. In another example, the perforating gun 12 could initially have the material 34 therein, and then the material could be removed from the interior of the body 26 to thereby increase the free gun volume to a desired level.

Figure 3:
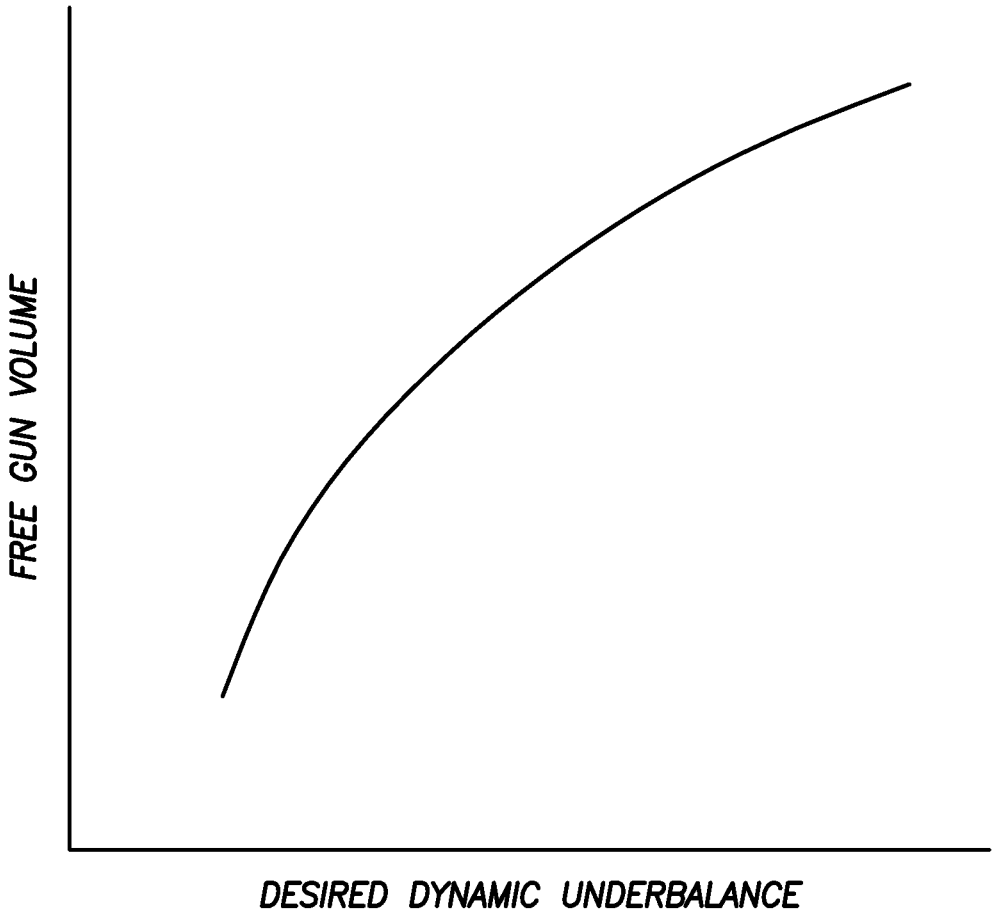
FIG. 3 is a representative graph of free gun volume vs. dynamic underbalance.

Referring additionally now to FIG. 3, a graph of free gun volume vs. desired dynamic underbalance is representatively illustrated. In this example, it can be seen that, as the free gun volume increases, the dynamic underbalance (pressure differential from the formation 22 to the wellbore 14) also increases.

The dynamic underbalance increases when more pressure reduction is produced following firing of the perforating gun 12. Therefore, the dynamic underbalance can be controlled by controlling the pressure reduction in the wellbore 14 following firing of the perforating gun 12.

However, it should be clearly understood that it is not necessary for the free gun volume and the dynamic underbalance to be related as depicted in FIG. 3, and it is not necessary for an underbalance to be created in other examples. The pressure reduction could result in less overbalance in some examples, rather than resulting in an underbalance.

Figure 4:
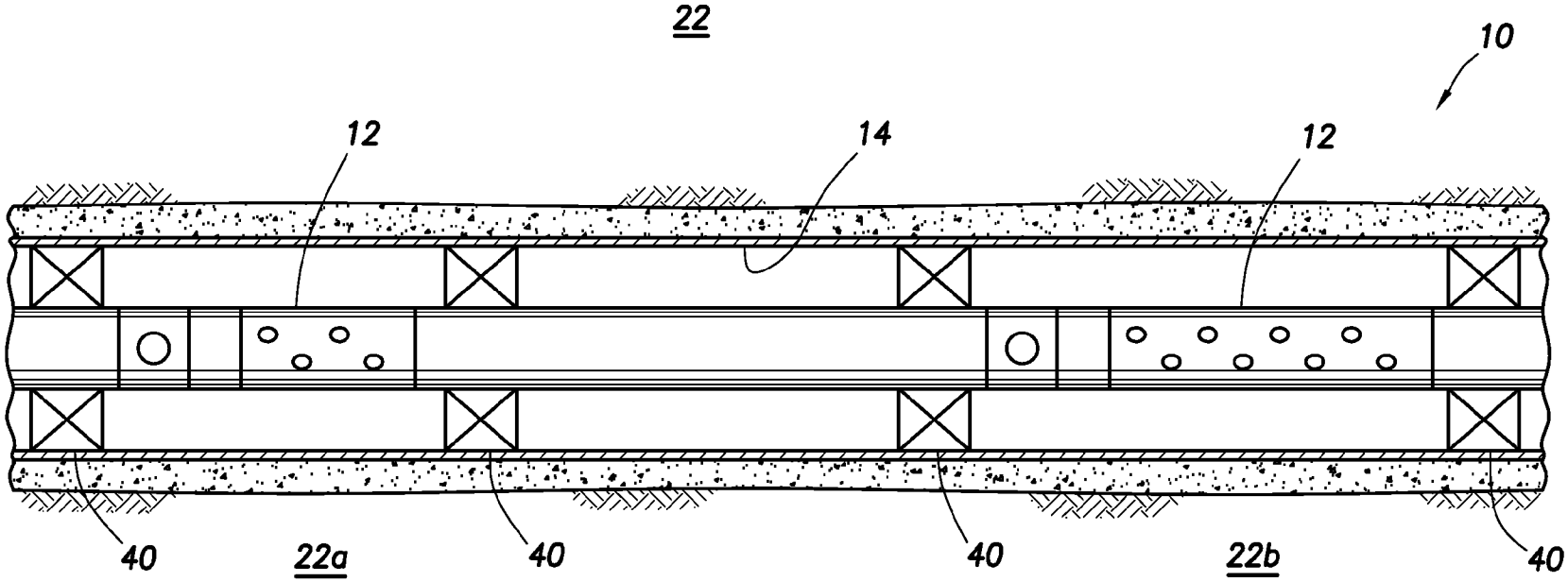
FIG. 4 is a representative partially cross-sectional view of another configuration of the well system.

Referring additionally now to FIG. 4, another configuration of the well system 10 is representatively illustrated. In this configuration, the wellbore 14 is generally horizontal, but the wellbore could extend in any direction in other examples.

Multiple intervals 22*a,b* are penetrated by the wellbore 14. These intervals 22*a,b* are isolated from each other in the wellbore 14 by packers 40. Multiple perforating guns 12 are to be used for perforating the respective multiple intervals 22*a,b*.

The intervals 22*a,b* could be different zones of the same earth formation 22, or they could be intervals of separate formations. If the intervals 22*a,b* have different characteristics, it may be advantageous to tailor the perforating operation, so that optimum pressure levels are achieved in the wellbore 14 adjacent each of the intervals.

For example, it may be advantageous to produce different pressure levels in the wellbore 14 adjacent the interval 22*a*, as opposed to pressure levels in the wellbore adjacent the interval 22*b*. Even if it is desired to produce the same pressure levels in the wellbore 14 adjacent both of the intervals 22*a,b*, different characteristics of the perforating guns 12, other components in the well, length of the intervals, etc., may require that the free gun volumes of the perforating guns be varied in order to achieve the desired pressure levels.

The methods described herein permit the free gun volumes of the perforating guns 12 to be individually varied, so that desired pressure reductions are produced following firing of the perforating guns. This allows an enhanced degree of customization of the perforating operation, so that optimum results can be more easily and economically achieved.

Although only one perforating gun 12 is depicted in FIG. 4 for each of the intervals 22*a,b*, it will be appreciated that any number of perforating guns could be used for any of the intervals. Where only one perforating gun 12 is shown in FIGS. 1 & 4, any other number, spacing, type, etc., of perforating guns may be used.

It may now be fully appreciated that the above disclosure provides advancements to the perforating art in the form of a method of adjusting a pressure reduction to occur in a wellbore 14 following firing of at least one perforating gun 12. The method can include determining a desired free gun volume which corresponds to a desired pressure reduction in the wellbore 14 resulting from firing of the perforating gun 12, and adjusting a free gun volume 32 of the perforating gun 12 until the free gun volume 32 is substantially the same as the desired free gun volume.

Adjusting the free gun volume 32 can include adjusting a volume of material 34 in the perforating gun 12.

The method can include positioning a cover 36 on a perforating charge 24, thereby isolating the material 34 from an interior 38 of the perforating charge 24.

The material 34 can be at least partially dispersible in well fluid. The material 34 may be at least partially dissolvable in well fluid.

The material 34 can be dissolvable in water or hydrocarbon fluid.

The at least one perforating gun 12 may comprise multiple perforating guns 12. The determining step can include determining an individual desired free gun volume for each of the perforating guns 12.

Also provided by this disclosure is a method of perforating multiple formation intervals 22*a,b*. The method can include determining a first desired free gun volume for a first one of the perforating guns 12; varying a free gun volume 32 of the first perforating gun 12 until the first perforating gun free gun volume 32 is substantially the same as the first desired free gun volume; determining a second desired free gun volume for a second one of the perforating guns 12; and varying a free gun volume 32 of the second perforating gun 12 until the second perforating gun free gun volume 32 is substantially the same as the second desired free gun volume.

The above disclosure also provides a well system 10 to the art. The well system 10 can include at least one perforating gun 12 positioned in a wellbore 14, the perforating gun 12 comprising multiple perforating charges 24 and a free gun volume 32. The free gun volume 32 can be reduced by presence of a flowable material 34 about the multiple perforating charges 24.

The well system of claim 14, wherein each perforating charge has a cover which excludes the material from an interior of the perforating charge.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of adjusting a pressure reduction to occur in a wellbore following firing of at least one perforating gun, the method comprising:

determining a desired free gun volume which corresponds to a desired pressure reduction in the wellbore resulting from firing of the perforating gun; and varying a free gun volume of the perforating gun by varying a volume of a flowable solid material in the perforating gun until the free gun volume is substantially the same as the desired free gun volume, wherein the material is dissolvable in well fluid, and wherein the material is selected from the group consisting of a rosemary extract powder and a chloride anion salt.

2. A method of adjusting a pressure reduction to occur in a wellbore following firing of at least one perforating gun, the method comprising:

determining a desired free gun volume which corresponds to a desired pressure reduction in the wellbore resulting from firing of the perforating gun; and varying a free gun volume of the perforating gun by varying a volume of a flowable solid material in the perforating gun until the free gun volume is substantially the same as the desired free gun volume, wherein the material is selected from the group consisting of a rosemary extract powder and a chloride anion salt, wherein the at least one perforating gun comprises multiple perforating guns, and wherein the determining step further comprises determining an individual desired free gun volume for each of the perforating guns.

3. A method of perforating multiple formation intervals with multiple perforating guns, the method comprising:

determining a first desired free gun volume for a first one of the perforating guns;

varying a first free gun volume of the first perforating gun by varying a volume of a first flowable solid material in the first perforating gun until the first perforating gun free gun volume is substantially the same as the first desired free gun volume;

determining a second desired free gun volume for a second one of the perforating guns; and varying a second free gun volume of the second perforating gun by varying a volume of a second flowable solid material in the second perforating gun until the second perforating gun free gun volume is substantially the same as the second desired free gun volume, wherein at least one of the first and second flowable solid materials is dissolvable in well fluid, and wherein the material is selected from the group consisting of a rosemary extract powder and a chloride anion salt.

4. The method of claim 3, further comprising positioning a cover on a perforating charge in the first perforating gun, thereby isolating the first flowable solid material from an interior of the perforating charge in the first perforating gun.

5. A well system, comprising:

at least one perforating gun positioned in a wellbore, the perforating gun comprising multiple perforating charges and a free gun volume, and the free gun volume being reduced by presence of a flowable solid material about the multiple perforating charges, wherein the material is dissolvable in well fluid, and wherein the material is selected from the group consisting of a rosemary extract powder and a chloride anion salt.

6. A well system, comprising:

multiple perforating guns positioned in a wellbore, each perforating gun comprising multiple perforating charges and an individual desired free gun volume, and an actual free gun volume of each perforating gun being reduced by presence of a flowable solid material about the multiple perforating charges, wherein the material is dissolvable in well fluid, wherein the material is selected from the group consisting of a rosemary extract powder and a chloride anion salt, and wherein at least two of the actual free gun volumes are different from each other.

* * * * *